US008235683B2

(12) United States Patent
Kinjo et al.

(10) Patent No.: US 8,235,683 B2
(45) Date of Patent: Aug. 7, 2012

(54) HERMETIC COMPRESSOR

(75) Inventors: Kenji Kinjo, Shiga (JP); Akira Nakano, Kyoto (JP); Takahide Nagao, Shiga (JP)

(73) Assignee: Panasonic Corporation, Osaka (JP)

( * ) Notice: Subject to any disclaimer, the term of this patent is extended or adjusted under 35 U.S.C. 154(b) by 305 days.

(21) Appl. No.: 12/743,093

(22) PCT Filed: Nov. 20, 2008

(86) PCT No.: PCT/JP2008/003404

§ 371 (c)(1),
(2), (4) Date: May 14, 2010

(87) PCT Pub. No.: WO2009/072244

PCT Pub. Date: Jun. 11, 2009

(65) Prior Publication Data

US 2010/0239438 A1 Sep. 23, 2010

(30) Foreign Application Priority Data

Dec. 6, 2007 (JP) ..... 2007-315627
May 12, 2008 (JP) ..... 2008-124322

(51) Int. Cl.
*F04B 39/00* (2006.01)

(52) U.S. Cl. ..... 417/312; 181/403

(58) Field of Classification Search ..... 417/312; 181/403

See application file for complete search history.

(56) References Cited

U.S. PATENT DOCUMENTS 4,960,368 A 10/1990 Lilie
5,201,640 A * 4/1993 Heinzelmann et al. ..... 417/312
5,496,156 A 3/1996 Harper et al.
5,971,720 A * 10/1999 Fagotti et al. ..... 417/312
6,220,050 B1 4/2001 Cooksey
2002/0090305 A1 7/2002 Myung et al.
2003/0150670 A1 * 8/2003 Svendsen et al. ..... 181/262
2004/0120832 A1 * 6/2004 Nishihara et al. ..... 417/312
2004/0241011 A1 * 12/2004 Yagi et al. ..... 417/312
2006/0039803 A1 * 2/2006 Nakano et al. ..... 417/312
2007/0154330 A1 * 7/2007 Freiberger ..... 417/312
2008/0267792 A1 * 10/2008 Yokota et al. ..... 417/312
2009/0004031 A1 * 1/2009 Umeoka et al. ..... 417/312

FOREIGN PATENT DOCUMENTS

EP 1413754 A1 4/2004
WO WO 98/07987 A1 2/1998
WO WO 2007/004725 A1 1/2007

OTHER PUBLICATIONS

International Search Report for International Application No. PCT/JP/2008/003404, dated Mar. 10, 2009, 3 pages.

* cited by examiner

*Primary Examiner* — Devon C. Kramer
*Assistant Examiner* — Yonas Cherkos
(74) *Attorney, Agent, or Firm* — Brinks Hofer Gilson & Lione

(57) ABSTRACT

A Inlet pipe (151) communicating the space inside the hermetic enclosure with sound absorbing space (147) of inlet muffler (145) is provided so as to be inclined downward from inlet-pipe inlet (155) toward inlet-pipe outlet (157). Outlet pipe (153) communicating sound absorbing space (147) with an inlet valve includes outlet-pipe inlet (161) and outlet-pipe outlet (163). Inlet-pipe inlet (155) and outlet-pipe inlet (161) are formed at substantially same height. Herewith, introducing a refrigerant gas to outlet-pipe inlet (161) making efficient use of potential energy of the refrigerant improves the compression efficiency and stabilizes the performance of the compressor.

15 Claims, 11 Drawing Sheets

HERMETIC COMPRESSOR

This application is a 371 application of PCT/JP2008/003404 having the international filing date of Nov. 20, 2008, which claims priority to JP2007-315627 filed on Dec. 6, 2007 and JP2008-124322 filed on May 12, 2008, the entire contents of which are incorporated herein by reference.

TECHNICAL FIELD

The present invention relates to a hermetic compressor used for a freezing and refrigerating apparatus (e.g. refrigerator, refrigerated display case), air conditioner, and other refrigeration cycle equipment.

BACKGROUND ART

In recent years, there has been an increasingly strong request for protecting the earth environment. In a refrigerator and other refrigeration cycle equipment, there has been a strong demand particularly for higher efficiency.

A hermetic compressor used for a freezing and refrigerating apparatus, air conditioner, and other refrigeration cycle equipment generally includes an inlet muffler for damping noise generated while a refrigerant gas is being suctioned, in its hermetic enclosure.

One of the causes of reducing the efficiency of a compressor including this inlet muffler is overheating of a refrigerant gas suctioned. The temperature of a refrigerant gas rises due to heat transmitted from some heat sources present inside the compressor until the refrigerant gas permeates the cylinder after it enters the compressor. The temperature rise of the refrigerant gas increases its ratio volume, causing the mass flow rate of the refrigerant gas to decrease.

The cooling performance of a compressor is proportional to the mass flow rate of the refrigerant gas, and thus decrease in the mass flow rate lowers the efficiency. Under the circumstances, patent citation 1 proposes an inlet muffler of a hermetic compressor that minimizes heat transmitted to a low-temperature refrigerant gas suctioned to the cylinder.

Hereinafter, a description is made of a conventional hermetic compressor disclosed in patent citation 1 with reference to the related drawings. FIG. 10 is a longitudinal sectional view of the conventional hermetic compressor described in patent literature 1. FIG. 11 is a sectional view of the substantial part of the conventional hermetic compressor. FIG. 12 is an exploded perspective view of a conventional inlet muffler.

As shown in FIGS. 10 through 12, the conventional hermetic compressor stores lubricating oil 3 at the bottom of hermetic enclosure 1 and is filled with refrigerant gas 20. Compressor unit 5 is elastically supported on hermetic enclosure 1 by suspension spring 7.

Compressor unit 5 is equipped with electromotive element 9, and compressing element 11 disposed above electromotive element 9, where electromotive element 9 includes stator 13 and rotor 15.

Compressing element 11 has crankshaft 17 including eccentric shaft 27 and main shaft 35. Compressing element 11 has block 23 integrally formed with cylinder 21 forming compression chamber 19. Compressing element 11 has piston 25, and valve plate 31 sealing the end surface of cylinder 21. Compressing element 11 has an inlet valve (not shown) for opening and closing inlet hole 33 (refer to FIG. 11) provided in valve plate 31. Compressing element 11 further has joint 29 connecting eccentric shaft 27 to piston 25.

Main shaft 35 of crankshaft 17 is pivotally supported rotatably on bearing 37 of block 23 and has rotor 15 fixed thereto. Crankshaft 17 includes an oiling mechanism (not shown).

Further, inlet muffler 41 is pinched and fixed between valve plate 31 attached onto the end surface of cylinder 21 and cylinder head 39 lidding valve plate 31.

As shown in FIGS. 11, 12, inlet muffler 41 is molded from a synthetic resin such as PBT (polybutylene terephthalate) and PPS (polyphenylene sulfite). Inlet muffler 41 includes muffler body 43 forming a sound absorbing space, and cover 60 having inlet pipe 45 and outlet pipe 47.

Inlet pipe 45 includes inlet-pipe outlet 49 open into muffler body 43. Inlet pipe 45 includes inlet-pipe inlet 51 outside cover 60, open into the space inside hermetic enclosure 1.

Outlet pipe 47 includes outlet-pipe inlet 53 open into muffler body 43. Outlet pipe 47 includes outlet-pipe outlet 55 outside cover 60, connected to cylinder head 39. Here, the arrows in FIG. 11 show the flow of refrigerant gas 20 inside inlet muffler 41.

Hereinafter, a description is made of the operation of a conventional hermetic compressor with the above-described structure. First, the hermetic compressor passes a current through stator 13 to generate a magnetic field, thereby rotating rotor 15 fixed to main shaft 35 to rotate crankshaft 17. This rotation reciprocates piston 25 in and along cylinder 21 through joint 29 rotatably attached onto eccentric shaft 27.

Then, the reciprocating movement of piston 25 makes repeating suction of refrigerant gas 20 into compression chamber 19; compression of gas 20; and discharge of gas 20 into the refrigeration cycle (not shown).

In this case, refrigerant gas 20 suctioned through inlet-pipe inlet 51 passes through inlet pipe 45 and is led into muffler body 43 through inlet-pipe outlet 49. After that, refrigerant gas 20 is suctioned through outlet-pipe inlet 53, passes through outlet pipe 47, and is introduced into compression chamber 19 from outlet-pipe outlet 55 through inlet hole 33.

Here, inlet muffler 41 reduces noise generated by intermittent suction of refrigerant gas 20. In addition, inlet muffler 41 formed from a resin with low heat transmission prevents overheating of refrigerant gas 20 passing through the inside of inlet muffler 41. Further, the space provided between inlet pipe 45 and muffler body 43 prevents heat transmission from high-temperature refrigerant gas 20 remaining in hermetic enclosure 1. These effects eventually increase the mass flow rate of refrigerant gas 20 suctioned into cylinder 21.

Lubricating oil 3 is conveyed from the bottom of hermetic enclosure 1 to compressing element 11 above through the oiling mechanism provided on crankshaft 17 with the aid of a centrifugal force and others caused by rotation of crankshaft 17.

Lubricating oil 3 conveyed first lubricates sliding parts such as those between crankshaft 17 and bearing 37. After that, lubricating oil 3 shatters into hermetic enclosure 1 from the top end of crankshaft 17 to lubricate piston 25, cylinder 21, and others. Additionally, lubricating oil 3 that has shattered adheres to hermetic enclosure 1. When the lubricating oil that has adhered flows down to the bottom through the inner wall surface of hermetic enclosure 1, heat transmits from lubricating oil 3 to hermetic enclosure 1. The heat that has transmitted into hermetic enclosure 1 is dissipated from hermetic enclosure 1 to the outside to cool the hermetic compressor.

Meanwhile, lubricating oil 3 that has shattered in hermetic enclosure 1, together with refrigerant gas 20, is suctioned into muffler body 43 as well. However, when refrigerant gas 20 is led into muffler body 43 at inlet-pipe outlet 49 to decrease the velocity of refrigerant gas 20, lubricating oil 3 is separated from refrigerant gas 20 to remain at the bottom of muffler body 43.

However, in the above-described conventional structure, refrigerant gas 20 led from inlet-pipe outlet 49 into muffler body 43 flows along the inner wall of the bottom of muffler body 43. As a result, lubricating oil 3 suctioned together with refrigerant gas 20, remaining at the bottom of muffler body 43 easily flows into outlet-pipe inlet 53 positioned close to the bottom of muffler body 43. Consequently, a large amount of lubricating oil 3 easily flows into compression chamber 19.

A large amount of lubricating oil 3 flowing into compression chamber 19 increases the load during compression, increases input to the hermetic compressor, and results in insufficient compression of refrigerant gas 20. This causes the freezing capacity to decrease and rapidly fluctuates such as a compression load, thereby undesirably generating noise.

Further, there is a problem of decreasing the performance of the heat exchanger as a result that a large amount of lubricating oil 3 is discharged into the refrigeration cycle.

Patent Citation 1

Japanese translation of PCT publication No. 2001-504189

DISCLOSURE OF THE INVENTION

According to the present invention, lubricating oil remaining at the bottom of a muffler body is prevented from flowing into the outlet-pipe inlet. This prevents the following problems. That is, the freezing capacity of a hermetic compressor decreases as a result that lubricating oil flows into the compression chamber, noise is generated, and the performance of the heat exchanger decreases.

A hermetic compressor of the present invention contains an electromotive element, and a compressing element driven by the electromotive element, in a hermetic enclosure that stores lubricating oil and has suction piping for making a refrigerant gas flow in. The compressing element includes a cylinder block forming a compression chamber, an inlet valve disposed at the end of the compression chamber, a piston reciprocating in and along the compression chamber, and an inlet muffler forming an sound absorbing space communicating with the compression chamber. The inlet muffler includes a hollow body forming the sound absorbing space, an inlet pipe communicating a space inside the hermetic enclosure with the sound absorbing space, and an outlet pipe communicating the sound absorbing space with the inlet valve. The inlet pipe is provided so as to be inclined downward from the inlet-pipe inlet having an opening open into a space inside the hermetic enclosure toward the inlet-pipe outlet having an opening open into the sound absorbing space. The outlet pipe includes an outlet-pipe inlet having an opening open into the sound absorbing space, and an outlet-pipe outlet having an opening open into the inlet valve. The inlet-pipe inlet and the outlet-pipe inlet are formed at the same height.

With this structure, the outlet-pipe inlet is separated from the bottom of the muffler body, and thus lubricating oil remaining at the bottom of the muffler body is resistant to flowing into the compression chamber. In addition, the refrigerant gas is introduced to the outlet-pipe inlet by efficiently using potential energy of the refrigerant gas introduced to the inlet-pipe inlet. This prevents lubricating oil remaining at the bottom of the muffler body from flowing into the compression chamber in a large amount. In addition, the structure reduces the suction loss of the refrigerant gas passing through the inside of the inlet muffler to improve the efficiency.

DETAILED DESCRIPTION OF THE PREFERRED EMBODIMENTS

Hereinafter, a description is made of a hermetic compressor according to several exemplary embodiments of the present invention with reference to the related drawings. The present invention is not limited by the embodiments.

First Exemplary Embodiment

Figure 1:
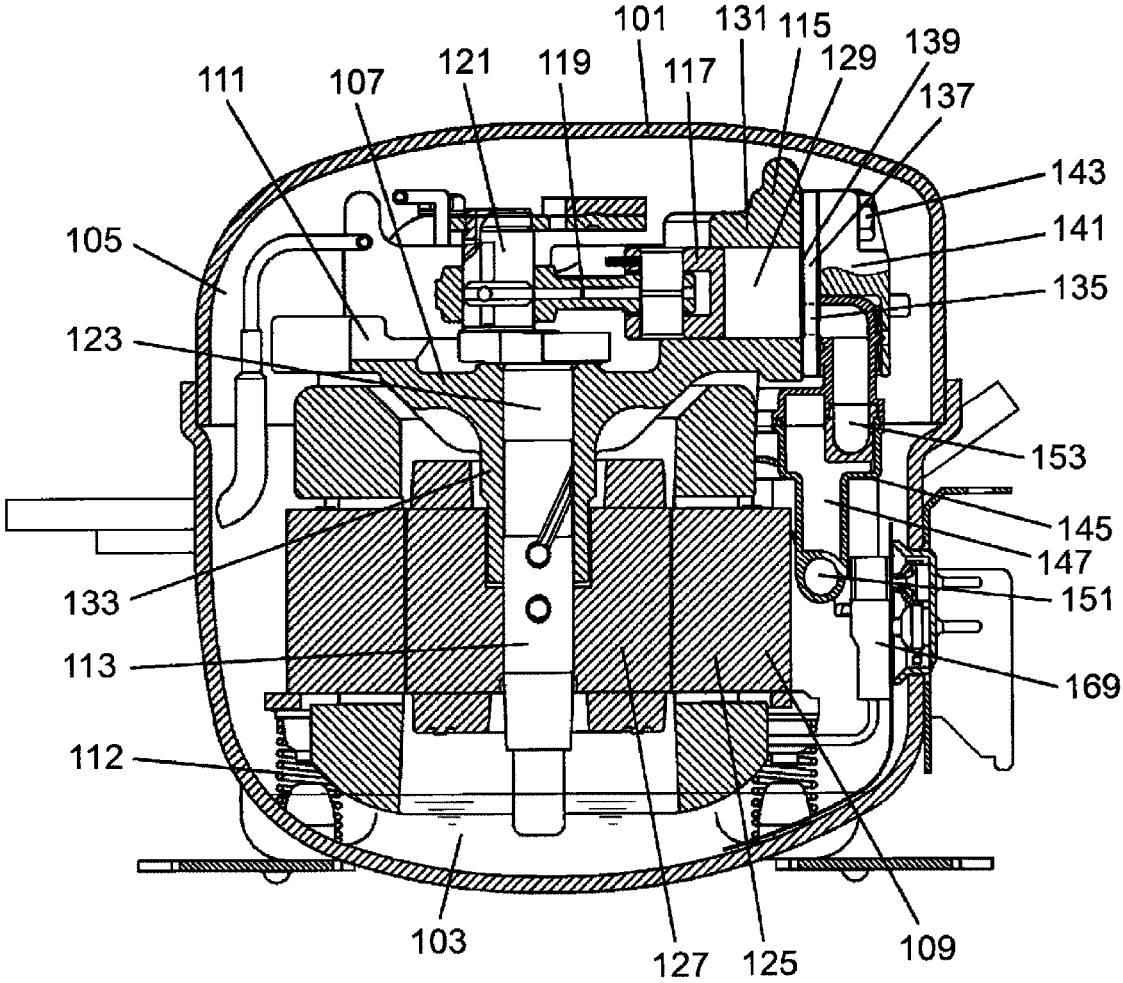
FIG. 1 is a side sectional view of a hermetic compressor according to the first exemplary embodiment of the present invention.
Figure 2:
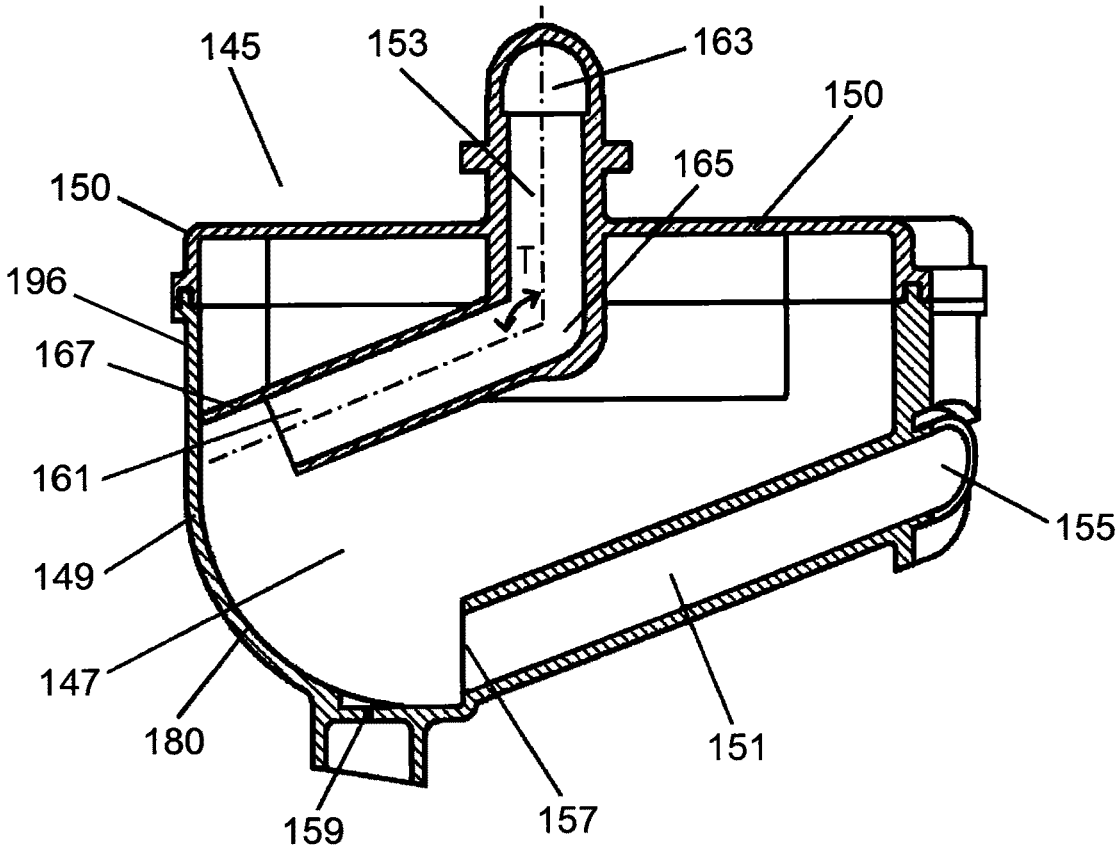
FIG. 2 is a sectional elevational view of the inlet muffler of the hermetic compressor of the embodiment.

FIG. 1 is a side sectional view of a hermetic compressor according to the first exemplary embodiment of the present invention. FIG. 2 is a sectional elevational view of the inlet muffler of the hermetic compressor of the embodiment.

In FIGS. 1 and 2, the hermetic compressor according to the embodiment stores lubricating oil 103 at the inner bottom of hermetic enclosure 101. Hermetic enclosure 101 has refrigerant gas 105 (e.g. R600a: hydrocarbon-series, low global warming potential) encapsulated thereinto.

Hermetic enclosure 101 contains compressor unit 111 including compressing element 107 and electromotive element 109, elastically supported by suspension spring 112 on hermetic enclosure 101.

Compressing element 107 is composed of crankshaft 113, cylinder block 115, piston 117, joint 119, and others. Crankshaft 113 includes eccentric shaft 121 and main shaft 123, as well as an oiling mechanism (not shown) communicating all the way from the bottom end of main shaft 123 immersed in lubricating oil 103 to the top end of eccentric shaft 121.

Electromotive element 109 is composed of stator 125 fixed to the lower part of cylinder block 115 with several bolts (not shown) and rotor 127 coaxially arranged inside stator 125, fixed to main shaft 123 by shrink-fitting.

Cylinder block 115 has cylinder 131 forming compression chamber 129, formed integrally with cylinder block 115. Cylinder block 115 further has bearing 133 pivotally supporting main shaft 123 rotatably.

Cylinder 131 has valve plate 137 including inlet hole 135 and a discharge hole (not shown); inlet valve 139 for opening and closing inlet hole 135; and cylinder head 141 for lidding valve plate 137, all fixed onto the end surface of cylinder 131. Valve plate 137, inlet valve 139, and cylinder head 141 are all press-fixed with head bolt 143 so as to seal the end surface of cylinder 131. Inlet muffler 145 is pinched and fixed between valve plate 137 and cylinder head 141.

Inlet muffler 145 is molded from a synthetic resin such as PBT with mainly glass fiber added thereto. As shown in FIG. 2, inlet muffler 145 is composed of muffler body 149 molded integrally with inlet pipe 151, and cover 150 molded integrally with outlet pipe 153. In other words, integrally combining muffler body 149 with cover 150 forms hollow body 196 containing sound absorbing space 147 inside thereof.

Inlet pipe 151, placed on the outer wall of muffler body 149, includes inlet-pipe inlet 155 having an opening open into the space inside hermetic enclosure 101, and inlet-pipe outlet 157 having an opening open into sound absorbing space 147 inside muffler body 149. Inlet pipe 151 is provided so as to be inclined downward from inlet-pipe inlet 155 toward inlet-pipe outlet 157.

Further, inlet-pipe outlet 157 is formed being open into the proximity of the bottom of sound absorbing space 147. The bottom of muffler body 149 near inlet-pipe outlet 157 has lubricating oil discharge hole 159 formed therein for discharging lubricating oil 103 outside sound absorbing space 147.

Outlet pipe 153 includes outlet-pipe inlet 161 having an opening open into sound absorbing space 147, and outlet-pipe outlet 163 having an opening open into inlet valve 139. In other words, outlet-pipe outlet 163, placed outside cover 150, is connected to cylinder head 141 and communicates with compression chamber 129 through inlet valve 139.

Outlet pipe 153 has curve 165 formed between outlet-pipe inlet 161 and outlet-pipe outlet 163 in sound absorbing space 147 by being bent so that curve angle T is obtuse.

Further, outlet pipe 153 is formed so that the heightwise position of the opening of outlet-pipe inlet 161 open into sound absorbing space 147 is at substantially the same height as inlet-pipe inlet 155. Outlet pipe 153 includes guide wall 167 covering the upper part of outlet-pipe inlet 161.

The back side (back side in FIG. 2) of inlet muffler 145 adjoins stator 125 and cylinder block 115, and has an outer shape running along stator 125 and cylinder block 115.

The front side (front side in FIG. 2) of inlet muffler 145 has an outer shape with its lower part thinner than the upper to ensure distance to power terminal 169 (refer to FIG. 1) for supplying a current to stator 125.

Further, inner wall surface 180 of muffler body 149 is formed with a curve so as to introduce refrigerant gas 105 from the lower part of hollow body 196 forming sound absorbing space 147 to the upper, between inlet-pipe outlet 157 and outlet-pipe inlet 161.

Piston 117, reciprocably inserted into cylinder 131, together with valve plate 137 form compression chamber 129. Further, piston 117 is connected to eccentric shaft 121 with joint 119.

A description is made of the operation and effect of the hermetic compressor with the above-described structure. The hermetic compressor passes a current through stator 125 via power terminal 169 to generate a magnetic field, thereby rotating rotor 127 fixed to main shaft 123. This rotates crankshaft 113 to reciprocate piston 117 in and along cylinder 131 through joint 119 rotatably attached to eccentric shaft 121. With the reciprocating movement of piston 117, refrigerant gas 105 is suctioned into compression chamber 129 through inlet muffler 145, compressed, and then discharged to the refrigeration cycle (not shown).

Inlet muffler 145 is composed of inlet pipe 151, outlet pipe 153, and sound absorbing space 147, to form an expansion muffler that reduces noise generated by intermittent suction of refrigerant gas 105.

Next, a description is made of a suction stroke of the hermetic compressor. When piston 117 moves in the direction increasing the volume of cylinder 131, refrigerant gas 105 inside compression chamber 129 expands. With this action, when the pressure inside compression chamber 129 falls below the suction pressure, inlet valve 139 starts to open due to the difference between the pressure inside compression chamber 129 and that inside inlet muffler 145.

Then, low-temperature refrigerant gas 105 that has returned from the refrigeration cycle is suctioned through inlet-pipe inlet 155, passes through inlet pipe 151, and is led into sound absorbing space 147. Then, refrigerant gas 105 led is suctioned through outlet-pipe inlet 161, passes through outlet pipe 153, and flows into compression chamber 129.

After that, when piston 117 turns from the bottom dead center to the direction decreasing the volume inside compression chamber 129, the pressure inside compression chamber 129 increases. With this action, inlet valve 139 closes due to the difference between the pressure inside compression chamber 129 and that inside inlet muffler 145.

Here, refrigerant gas 105 suctioned into compression chamber 129 remaining in sound absorbing space 147 for a long time increases its temperature under the influence of such as heat generation by electromotive element 109. In this embodiment, however, inlet-pipe outlet 157 is formed near the bottom of sound absorbing space 147, and outlet pipe 153 is provided with guide wall 167 covering the upper part of outlet-pipe inlet 161. Further, the inner wall surface of muffler body 149 is formed so as to introduce refrigerant gas 105 from the lower part of hollow body 196 forming sound absorbing space 147 to the upper, between inlet-pipe outlet 157 and outlet-pipe inlet 161. Consequently, refrigerant gas 105 is introduced from the lower part of sound absorbing space 147 to the upper along curved inner wall surface 180 of muffler body 149 from inlet-pipe outlet 157. Further, refrigerant gas 105 that has reached the proximity of outlet-pipe inlet 161 is guided into outlet pipe 153 with the aid of guide wall 167. Hence, refrigerant gas 105 passes through sound absorbing space 147 in a shorter time.

In other words, refrigerant gas 105 receives less heat in sound absorbing space 147, and thus refrigerant gas 105 with a higher density is suctioned into compression chamber 129. Consequently, the mass flow rate of refrigerant gas 105 increases to improve the volume efficiency.

In this embodiment, guide wall 167 covering the upper part of outlet-pipe inlet 161 is provided. However, guide wall 167 provided near outlet-pipe inlet 161 inside muffler body 149 provides the same effect.

Besides, without guide wall 167 provided, simply forming outlet-pipe inlet 161 in sound absorbing space 147 near the inner wall surface of muffler body 149 allows refrigerant gas 105 to be introduced from inlet-pipe outlet 157 to outlet-pipe inlet 161. Hence, even such a structure reduces the suction loss and heat receiving loss.

In this embodiment, inlet pipe 151 is inclined downward from inlet-pipe inlet 155 toward inlet-pipe outlet 157. Further, outlet-pipe inlet 161 and inlet-pipe inlet 155 are formed at substantially the same height. In addition, inner wall surface 180 of muffler body 149 is formed so as to introduce refrigerant gas 105 from the lower part of sound absorbing space 147 to the upper, between inlet-pipe outlet 157 and outlet-pipe inlet 161. That is, outlet-pipe inlet 161 is arranged at a height at which potential energy of refrigerant gas 105 at inlet-pipe inlet 155 is effectively used, and thus refrigerant gas 105 introduced to inlet-pipe inlet 155 is efficiently introduced to outlet-pipe inlet 161. Hence, energy required for introducing refrigerant gas 105 to the upper part of sound absorbing space 147 is reduced as well as the suction loss.

Here, outlet-pipe inlet 161 and inlet-pipe inlet 155 are formed at substantially same height. Concretely, at least a part of outlet-pipe inlet 161 overlapping with inlet-pipe inlet 155 horizontally provides the above-described effect.

Besides, even if outlet-pipe inlet 161 does not overlap with inlet-pipe inlet 155 horizontally, the above-described effect is available as well if the lowermost end of outlet-pipe inlet 161 is positioned above the uppermost part of inlet-pipe inlet 155 within a range of the diameter of inlet pipe 151 or outlet pipe 153. In the same way, the above-described effect is available as well if the uppermost end of outlet-pipe inlet 161 is positioned below the lowermost part of inlet-pipe inlet 155 within a range of the diameter of inlet pipe 151 or outlet pipe 153.

Next, a description is made of the operation of lubricating oil 103. Lubricating oil 103 stored at the inner bottom of hermetic enclosure 101 is conveyed to the upper part of compressing element 107 by an oiling mechanism assisted by a centrifugal force produced by rotation of crankshaft 113 and a viscous frictional force produced at sliding parts. Lubricating oil 103 that has been conveyed to compressing element 107 lubricates sliding parts of main shaft 123 and eccentric shaft 121, and shatters from the top end of crankshaft 113.

Lubricating oil 103 that has shattered in the space inside hermetic enclosure 101 sprinkles over sliding parts of piston 117 and cylinder 131 to lubricate them. Further, lubricating oil 103 that has increased its temperature at sliding parts and others adheres to the inner surface of hermetic enclosure 101, and dissipates heat outward through hermetic enclosure 101 to cool the hermetic compressor.

Moreover, part of lubricating oil 103 that has shattered in the space inside hermetic enclosure 101, together with refrigerant gas 105, is suctioned through inlet-pipe inlet 155 of inlet muffler 145.

Then, refrigerant gas 105 is led into sound absorbing space 147 in hollow body 196 with a large volume through inlet pipe 151. When the flow velocity of refrigerant gas 105 decreases, lubricating oil 103 is separated from refrigerant gas 105 and falls on the bottom of hollow body 196 by gravitation.

Lubricating oil 103 that has fallen is immediately discharged from the current position to the outside of inlet muffler 145 through lubricating oil discharge hole 159 formed at the bottom of muffler body 149 near inlet-pipe outlet 157. Hence, lubricating oil 103 remaining in inlet muffler 145 is reduced.

In this embodiment, inlet pipe 151 is inclined downward from inlet-pipe inlet 155 toward inlet-pipe outlet 157. Further, outlet-pipe inlet 161 and inlet-pipe inlet 155 are formed at substantially the same height. Furthermore, the inner wall surface of muffler body 149 is formed so as to introduce refrigerant gas 105 from the lower part of hollow body 196 forming sound absorbing space 147 to the upper, between inlet-pipe outlet 157 and outlet-pipe inlet 161. This structure promotes separating lubricating oil 103 from refrigerant gas 105 while they are flowing from inlet pipe 151 to outlet pipe 153. In addition, even if lubricating oil 103 remains at the bottom of muffler body 149 to some extent, a large amount of lubricating oil 103 is prevented from flowing into compression chamber 129 through outlet pipe 153 because outlet-pipe inlet 161 is arranged above the bottom of muffler body 149 with an adequate distance (nearly the same height as inlet-pipe inlet 155). This prevents generation of noise and breakage of the valve and other parts.

Figure 3:
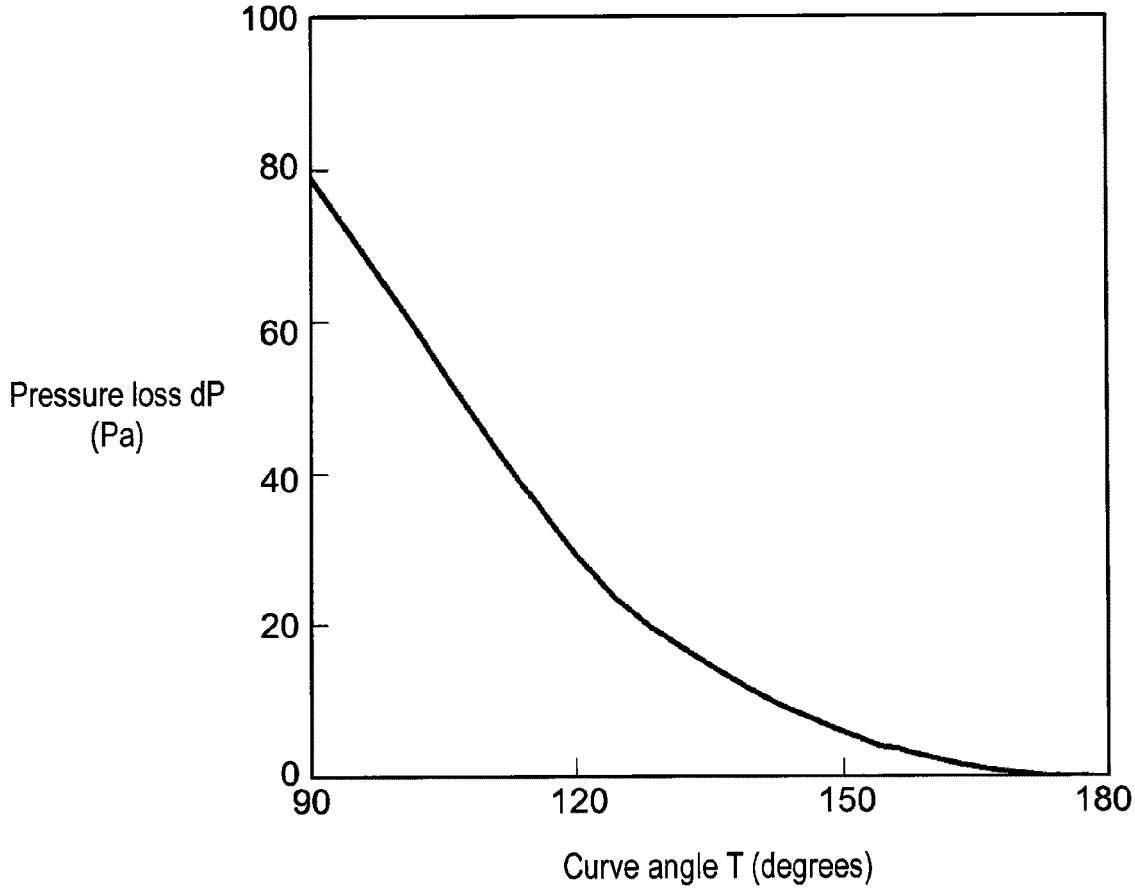
FIG. 3 is a characteristic diagram showing the relationship between the curve angle of piping and pressure loss.

Next, a description is made of pressure loss at outlet pipe 153. FIG. 3 is a characteristic diagram showing the relationship between the curve angle of piping and pressure loss.

In FIG. 3, the vertical axis represents pressure loss dP (Pa) due to a curve of piping; the horizontal axis, curve angle T (degrees) of piping. Pressure loss dP due to a curve of piping is zero when the curve angle is 180 degrees (straight pipe), and increases exponentially as the curve angle is more acute.

When inlet muffler 145 is arranged at power terminal 169 as in this embodiment, distance to power terminal 169 needs to be ensured. The front side of inlet muffler 145 is thinner at its lower part than its upper. For this reason, curve angle T of outlet pipe 153 is usually set to the right angle (90 degrees) to ensure an appropriate length of outlet pipe 153.

Inlet muffler 145 of this embodiment, however, is formed so that curve angle T of outlet pipe 153 is obtuse at curve 165 of the central part. Consequently, the pressure loss of refrigerant gas 105 passing through outlet pipe 153 is reduced to improve the volume efficiency.

That is, in this embodiment, in order to achieve a balance between reducing pressure loss at outlet pipe 153 and ensuring an appropriate length of outlet pipe 153, the central part of outlet pipe 153 has curve 165 with obtuse curve angle T formed. Curve angle T between 95 degrees and 150 degrees provides a favorable characteristic.

Meanwhile, inlet muffler 145 is formed from a PBT resin with a significantly low heat transmission compared to metal or other substances. Consequently, low-temperature refrigerant gas 105 that has returned from the refrigeration cycle is prevented from being heated in sound absorbing space 147, thereby further preventing the performance degration.

In this embodiment, inlet-pipe inlet 155 is positioned above inlet-pipe outlet 157, and thus relatively upward in hermetic enclosure 101. Consequently, even if the pressure inside hermetic enclosure 101 rapidly decreases to cause refrigerant gas 105 that has dissolved into lubricating oil 103 to foam and to cause the fluid level to rise, lubricating oil 103 is resistant to flowing into inlet muffler 145.

As described above, in this embodiment, inlet muffler 145 has inlet pipe 151 inclined downward from the space inside hermetic enclosure 101 toward sound absorbing space 147, and inlet-pipe inlet 155 and outlet-pipe inlet 161 are formed at substantially the same height. This structure allows outlet-pipe inlet 161 to be placed upward away from the bottom of muffler body 149, thereby preventing lubricating oil 103 remaining at the bottom of muffler body 149 from flowing into compression chamber 129 in a large amount. Further, refrigerant gas 105 is introduced to outlet-pipe inlet 161 by efficiently using potential energy of refrigerant gas 105 introduced to inlet-pipe inlet 155. This reduces the suction loss, improves the efficiency, and stabilizes the performance.

According to this embodiment, outlet pipe 153 has curve 165 curving obtusely at the central part between outlet-pipe inlet 161 and outlet-pipe outlet 163, thereby reducing the pressure loss inside outlet pipe 153 to provide higher efficiency.

According to this embodiment, inlet-pipe outlet 157 is formed at the bottom of hollow body 196 forming sound absorbing space 147. Additionally, the inner wall surface of hollow body 196 is formed so as to introduce refrigerant gas 105 from the lower part of sound absorbing space 147 to the upper, between inlet-pipe outlet 157 and outlet-pipe inlet 161. This structure allows refrigerant gas 105 led from inlet-pipe outlet 157 to be introduced to outlet-pipe inlet 161 efficiently. This structure further promotes separating lubricating oil 103 from refrigerant gas 105 while they are flowing from inlet pipe 151 to outlet pipe 153, thereby reducing the pressure loss and heat receiving loss to increase the efficiency. Moreover, lubricating oil 103 is prevented from flowing into compression chamber 129 in a large amount.

According to this embodiment, lubricating oil discharge hole 159 is formed near inlet-pipe outlet 157. Hence, by releasing refrigerant gas 105 from inlet-pipe outlet 157 to sound absorbing space 147 with a large volume to decrease the velocity of refrigerant gas 105, lubricating oil 103 is effectively separated from refrigerant gas 105. Further, immediately after separated, lubricating oil 103 is discharged from the current position to the outside of inlet muffler 145. Hence, lubricating oil 103 is prevented from further flowing into compression chamber 129 in a large amount, thereby stabilizing the performance.

According to this embodiment, guide wall 167 for guiding refrigerant gas 105 in sound absorbing space 147 into outlet pipe 153 is arranged so as to cover the upper part of outlet-pipe inlet 161. This arrangement allows refrigerant gas 105 led from inlet-pipe outlet 157 to be introduced into outlet pipe 153 efficiently with the aid of guide wall 167. This further reduces the pressure loss and heat receiving loss, thereby increasing the efficiency.

According to this embodiment, outlet-pipe inlet 161 is open into sound absorbing space 147 near inner wall surface 180 of muffler body 149. Consequently, refrigerant gas 105 led from inlet-pipe outlet 157 is efficiently introduced to outlet pipe 153 with the aid of inner wall surface 180 of muffler body 149. Hence, the pressure loss and heat receiving loss are further reduced to further improve the volume efficiency.

Second Exemplary Embodiment

Figure 4A:
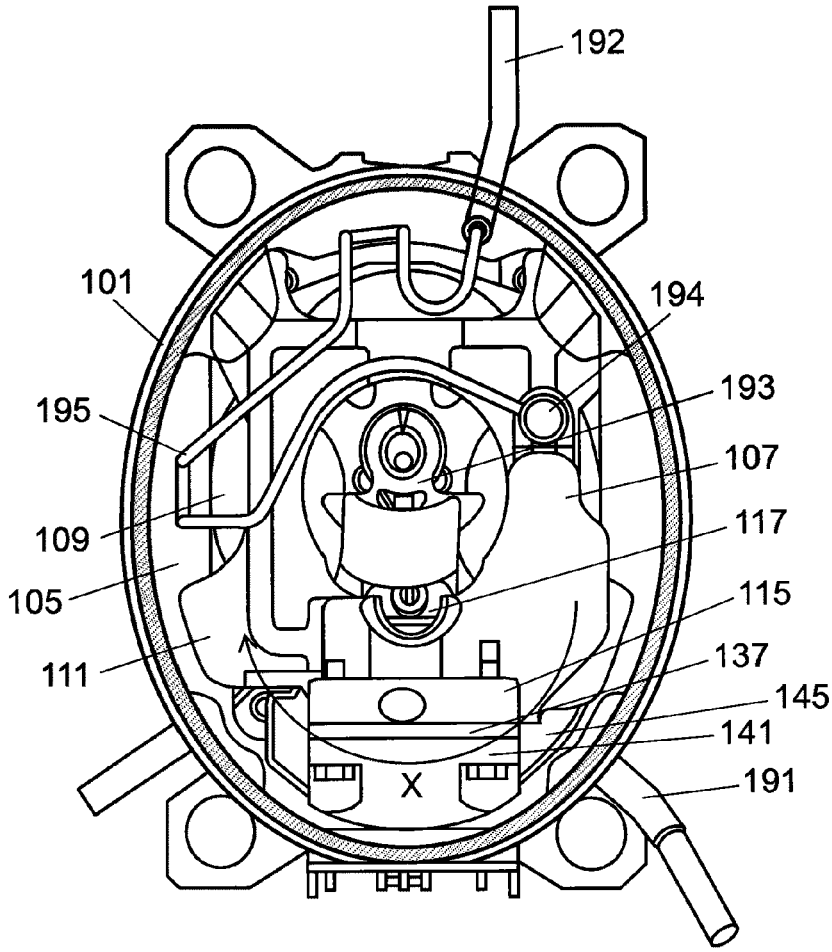
FIG. 4A is a sectional view of the upper surface of a hermetic compressor according to the second exemplary embodiment of the present invention.
Figure 4B:
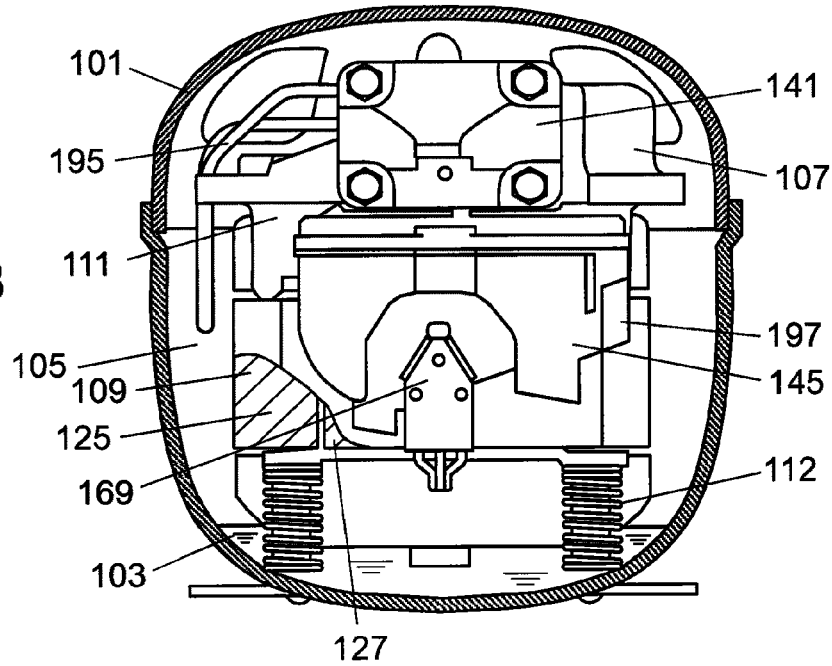
FIG. 4B is a sectional elevational view of the hermetic compressor according to the embodiment.
Figure 5A:
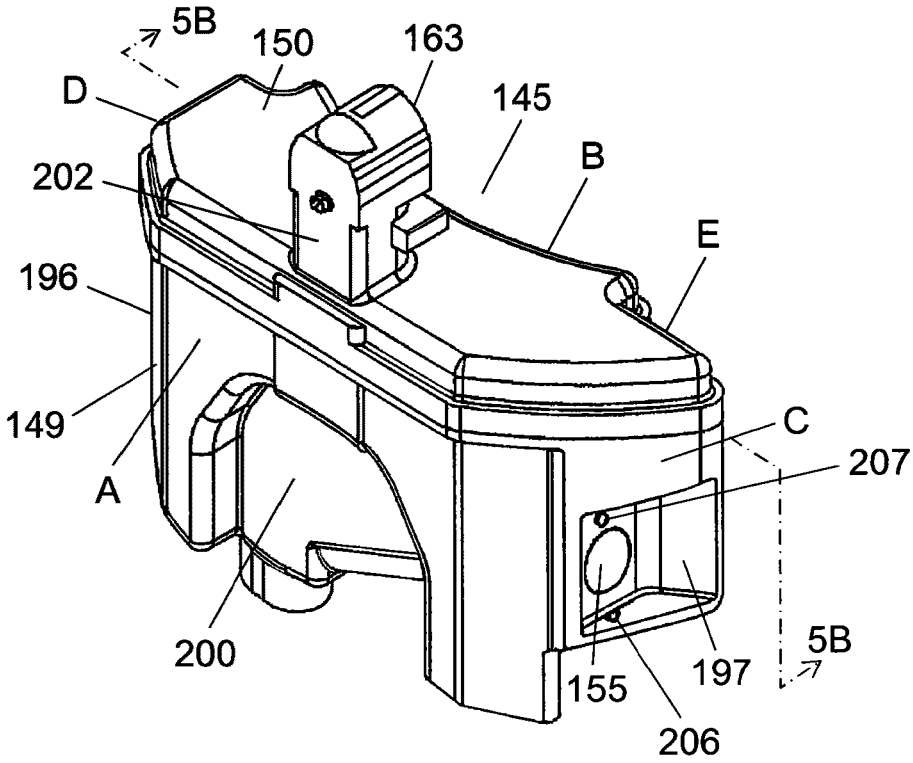
FIG. 5A is a perspective view illustrating the inlet muffler according to the embodiment.
Figure 5B:
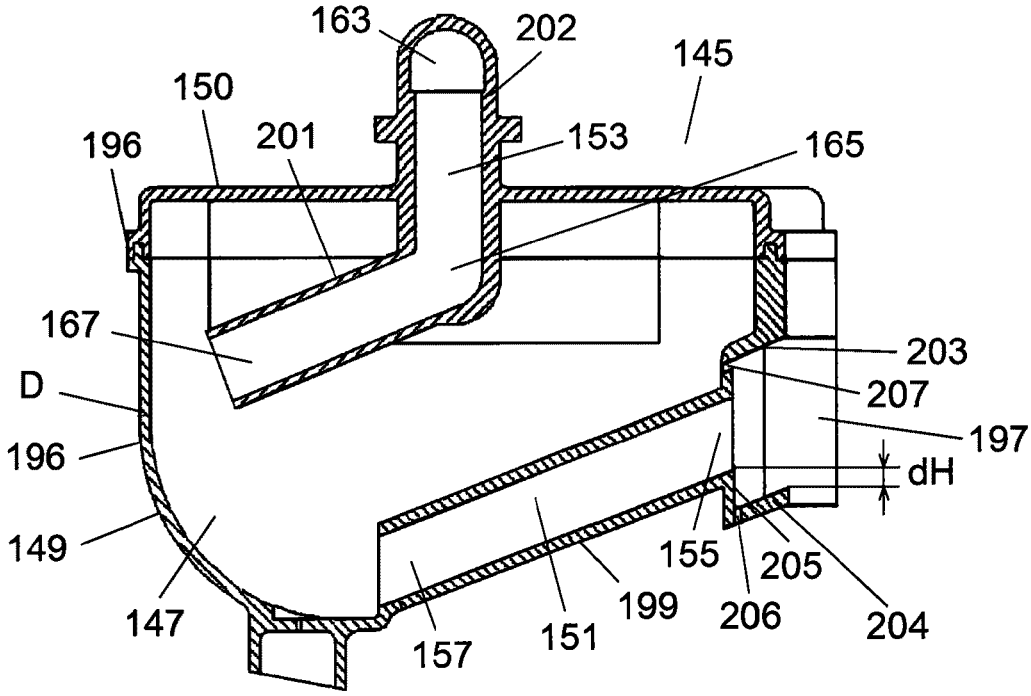
FIG. 5B is a cross sectional view of FIG. 5A, taken along line 5B-5B.
Figure 6:
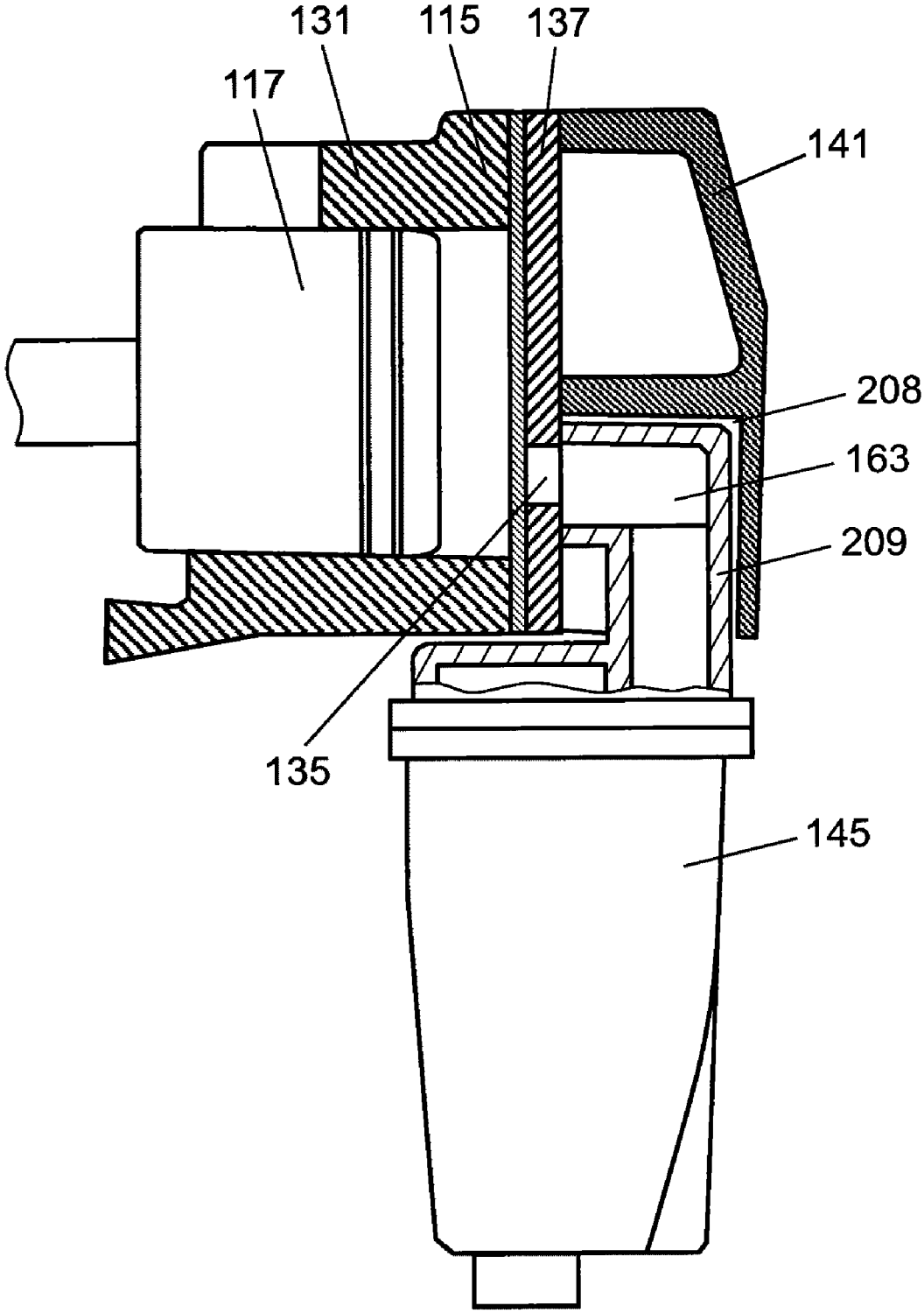
FIG. 6 is a sectional view illustrating the inlet muffler of the embodiment, in a state of attached to the compressing element.
Figure 7:
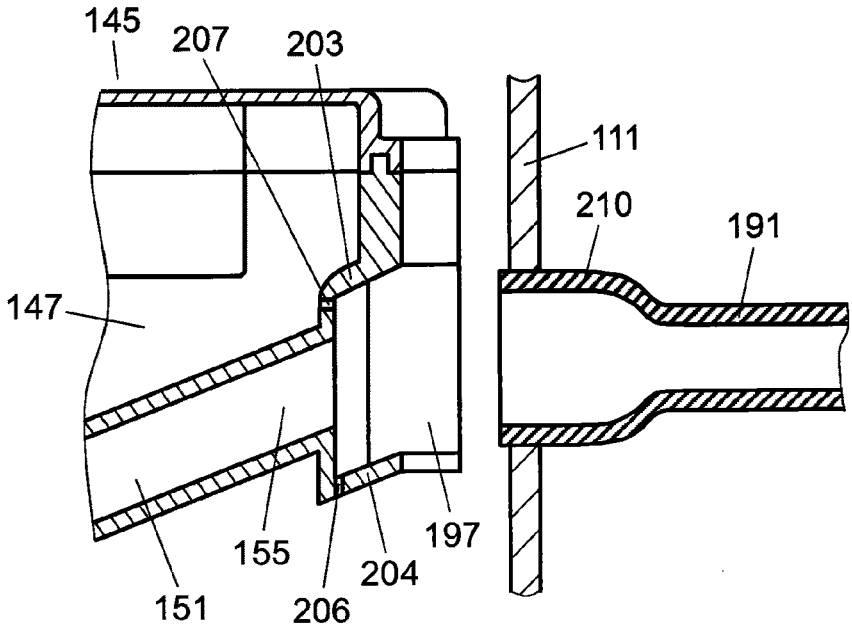
FIG. 7 is a block diagram of the open end of the suction piping of the embodiment.
Figure 8:
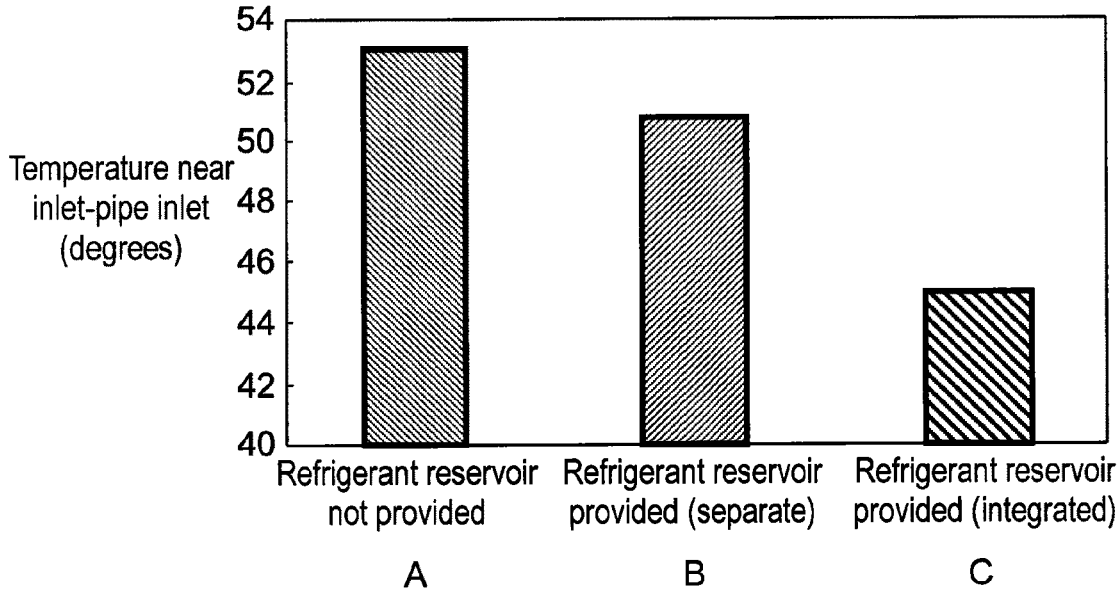
FIG. 8 is a characteristic diagram showing the measurement result of temperature of a refrigerant gas in the embodiment.

FIG. 4A is a sectional view of the top surface of a hermetic compressor according to the second exemplary embodiment of the present invention. FIG. 4B is a sectional elevational view of the same. FIG. 5A is a perspective view illustrating the entire shape of inlet muffler 145 of the embodiment. FIG. 5B is a cross sectional view of FIG. 5A, taken along line 5B-5B. FIG. 6 is a sectional view illustrating inlet muffler 145 of the embodiment, in a state attached to the compressing element. FIG. 7 is a cross sectional block diagram of the proximity of the open end of suction piping of the embodiment. FIG. 8 shows the measurement result of the temperature of a refrigerant gas in the embodiment.

In FIGS. 4A, 4B, although the basic structure is the same as that in the first embodiment shown in FIG. 1, the direction of the cross section is different from that in FIG. 1, and thus a description is made again. Hermetic enclosure 101, which is the outermost element, includes suction piping 191 for making refrigerant gas 105 flow into the hermetic enclosure 101, and discharge piping 192 for making refrigerant gas 105 flow outward. Suction piping 191 and discharge piping 192 are attached so that they are separated from each other in the circumferential direction and pierce the side wall of hermetic enclosure 101.

The bottom of hermetic enclosure 101 stores lubricating oil 103. Hermetic enclosure 101 contains electromotive element 109 and compressing element 107 driven by electromotive element 109, for suctioning and compressing refrigerant gas 105. Hermetic enclosure 101 further contains inlet muffler 145 provided on the path through which compressing element 107 suctions refrigerant gas 105.

Electromotive element 109 is attached to the bottom of hermetic enclosure 101 through four suspension springs 112. Compressing element 107 is equipped with cylinder block 115 including cylinder 131 (refer to FIG. 6) and piston 117 reciprocably insert-installed into cylinder 131. Compressing element 107 has crank mechanism 193 (known art) that is driven by electromotive element 109 and changes rotational movement into reciprocating movement to reciprocate piston 117. Crank mechanism 193 is composed of joint 119, eccentric shaft 121, and other components, shown in FIG. 1. Cylinder block 115 is attached to stator 125 of electromotive element 109 to support crank mechanism 193.

Compressing element 107 is further equipped with valve plate 137 arranged at the open end of cylinder 131, and cylinder head 141 attached to the side opposite to cylinder 131. Cylinder block 115 has a hole-cast space (not shown) formed therein functioning as a discharge muffler for refrigerant gas 105. Outlet 194 of cylinder block 115 is connected to discharge piping 192 with refrigerant lead-out pipe 195 appropriately bent lengthwise halfway so as to absorb vibration.

Inlet muffler 145 is arranged at the outer circumference of electromotive element 109 at the bottom of cylinder head 141. Inlet muffler 145 has hollow body 196, inlet pipe 151, and outlet pipe 153, as described later using FIGS. 5A, 5B. Inlet muffler 145 has refrigerant reservoir 197 formed from a depressed part in a range including inlet-pipe inlet 155 of inlet pipe 151. Refrigerant reservoir 197 may have a wall-surface shape, instead of a depressed part, for allowing refrigerant gas 105 to remain at inlet-pipe inlet 155. That is, refrigerant reservoir 197 may be of any shape as long as refrigerant gas 105 is allowed to remain in a range including at least inlet-pipe inlet 155. In inlet muffler 145, outlet-pipe outlet 163 of outlet pipe 153 is retained by cylinder head 141.

When electromotive element 109 drives compressing element 107, rotation of rotor 127 induces a flow of refrigerant gas 105 in hermetic enclosure 101 in the direction shown by arrow X. Inlet-pipe inlet 155 of inlet pipe 151 of inlet muffler 145 and refrigerant reservoir 197 are arranged upstream in the flowing direction of refrigerant gas 105 and on the side wall of hollow body 196, opposite to the surface that the flow of refrigerant gas 105 first touches. Then, suction piping 191 is attached to hermetic enclosure 101 at a position facing refrigerant reservoir 197 of inlet muffler 145.

As to a hermetic compressor with the above-described structure, a description is made of the detailed structure and operation of inlet muffler 145 after its general operation is described. When electromotive element 109 drives crank mechanism 193, it reciprocates piston 117 to repeat a suction stroke and compression stroke (both are known arts).

In a suction stroke, refrigerant gas 105 is suctioned into hermetic enclosure 101 from the cooling system through suction piping 191. Refrigerant gas 105 suctioned remains at refrigerant reservoir 197, and then flows into inlet muffler 145 through inlet pipe 151. After that, refrigerant gas 105 flows out of inlet muffler 145 through outlet pipe 153, and then is suctioned into the cylinder through inlet hole 135 (refer to FIG. 6) of valve plate 137.

In a compression stroke, refrigerant gas 105 compressed in the cylinder undergoes a noise-canceling process in a hole-cast space formed inside compressing element 107, and then is discharged into the cooling system through refrigerant lead-out pipe 195 and discharge piping 192.

Here, crank mechanism 193 includes the crankshaft shown in FIG. 1 (main shaft 123 in FIG. 1). The bottom end of the crankshaft has a pump mechanism (not shown) formed, which pumps up lubricating oil 103. Lubricating oil 103 pumped up is fed to crank mechanism 193 itself and the sliding part of piston 117. At this moment, part of lubricating oil 103 pumped up is turned into a spray to be mixed with refrigerant gas 105, and part of the mixed gas is suctioned through inlet pipe 151 of inlet muffler 145 in a suction stroke.

Next, a description is made of inlet muffler 145. In FIGS. 5A, 5B, hollow body 196 made of a synthetic resin material such as PBT and PPS is formed so as to demarcate sound absorbing space 147 inside being integrated by welding or bonding the opening of muffler body 149 with that of cover 150.

This hollow body 196 has recess 200 at the lower part of one flat side wall in order to ensure a space in which electric components are attached to power terminal 169 shown in FIG. 4B. The side wall having recess 200 is assumed to be side wall A; that facing A, side wall B; and those adjacent to the right and left of A, side walls C and D, respectively. Further, the side wall curved from B toward A, obliquely facing C is assumed to be side wall E.

Side wall B has a wall surface with its horizontal cross section arc-shaped so as to maintain a predetermined clearance from the outer side surface of electromotive element 109. Side walls C, D have wall surfaces with their horizontal cross sections arc-shaped that maintain substantially constant clearance from the inner side surface of hermetic enclosure 101.

Of these side walls, side wall C has refrigerant reservoir 197 formed from a depressed part, and inlet pipe 151 is provided inside hollow body 196, with the back part of refrigerant reservoir 197 as inlet-pipe inlet 155. Inner tube portion 199 of inlet pipe 151 is provided extending obliquely downward to the bottom of hollow body 196, and inlet-pipe outlet 157 faces side wall D.

Meanwhile, cover 150 has outlet pipe 153 extending to the inside and outside of hollow body 196. Inner extended part 201 of outlet pipe 153 is provided extending obliquely downward substantially in parallel with inlet pipe 151, and outlet-pipe inlet 167 faces side wall D. In this case, outlet-pipe inlet 167 of outlet pipe 153 is positioned near the heightwise central part of hollow body 196. Outer end 202 of outlet pipe 153 projects upward, and outlet-pipe outlet 163 faces in the direction orthogonally to the surface of side wall B.

Refrigerant reservoir 197 is formed slightly below side wall C, and a part of the upper part adjoins sound absorbing space 147 with the wall placed therebetween. In other words, refrigerant reservoir 197 is formed so as to adjoin sound absorbing space 147 through upper wall 203.

Lower wall 204 of refrigerant reservoir 197 is inclined downward toward inlet-pipe inlet 155. Inlet pipe 151 is arranged so that the inner wall surface of inlet-pipe inlet 155 is positioned above the wall surface of lower wall 204 by the height of stepped part 205 (a step height of dH).

Further, lower wall 204 of refrigerant reservoir 197 is provided therein with discharge hole 206 for lubricating oil 103 deposited in an suction process of refrigerant gas 105. Furthermore, upper wall 203 has communicating hole 207 formed therein for communicating sound absorbing space 147 directly with refrigerant reservoir 197. Here, discharge hole 206 and communicating hole 207 may be of any diameter of 0.5 mm or longer.

In FIG. 6, piston 117 is reciprocably insert-installed into cylinder 131 of cylinder block 115. The open end of cylinder 131 has valve plate 137 with inlet hole 135 attached thereto. In addition, cylinder head 141 is attached to valve plate 137 at the side opposite to cylinder 131.

Cylinder head 141 has concave part 208 formed therein. Valve plate 137 and cylinder head 141 are integrally mounted to cylinder block 115 with outer end 202 of outlet pipe 153 of inlet muffler 145 contained in concave part 208. At this moment, outlet-pipe outlet 163 of outlet pipe 153 is made face inlet hole 135, and connects to inlet hole 135 as a flow path for refrigerant gas 105.

In FIG. 7, inlet muffler 145 and suction piping 191 are arranged so that refrigerant reservoir 197 of inlet muffler 145 and open end 210 of suction piping 191 mutually face. In this case, to increase the facing area, the internal diameter of suction piping 191 is expanded at open end 210 more than at the other parts, relative to the vertical length of refrigerant reservoir 197. In this embodiment, the internal diameter of open end 210 of suction piping 191 is set so as to be within the range between 50% and 100% of the vertical length of refrigerant reservoir 197, which allows most of the refrigerant gas discharged from the open end of suction piping 191 to be suctioned from refrigerant reservoir 197 without pressure loss.

If the internal diameter of open end 210 of suction piping 191 exceeds 50% of the vertical length of refrigerant reservoir 197, open end 210 of suction piping 191 can reliably face refrigerant reservoir 197 even if electromotive element 109 or compressing element 107 fluctuates with operation. Next, a description is made of the operation related to inlet muffler 145. Inlet muffler 145 is attached to cylinder head 141 with side wall A being outside and with side wall B being inside, relative to the central part of hermetic enclosure 101 to which electromotive element 109 is attached. At this moment, side wall C on which refrigerant reservoir 197 is formed is positioned close to the inner wall surface of hermetic enclosure 101 and additionally refrigerant reservoir 197 faces open end 210 of suction piping 191.

Rotation of the rotor of electromotive element 109 induces a flow of refrigerant gas 105 in hermetic enclosure 101. Inlet-pipe inlet 155 of inlet pipe 151 and refrigerant reservoir 197 are arranged upstream from hollow body 196 in the flowing direction of the gas (the direction of arrow X in FIG. 4A). Refrigerant reservoir 197 faces suction piping 191 close to it, and thus the gas flow is to first touch side wall E of inlet muffler 145.

Hence, side wall C obliquely facing side wall E is opposite to the surface that the flow of the refrigerant gas first touches. Accordingly, refrigerant gas 105 heated in hermetic enclosure 101 does not directly touch inlet-pipe inlet 155 of inlet pipe 151. Furthermore, what is suctioned into inlet muffler 145 is refrigerant gas 105 that has flown from suction piping 191 to remain in refrigerant reservoir 197. Hence, high-temperature refrigerant gas 105 flowing in the compressor is prevented from entering inlet muffler 145 to a minimum.

When refrigerant gas 105 remaining in refrigerant reservoir 197 is suctioned into inlet pipe 151, refrigerant reservoir 197 is formed so as to adjoin sound absorbing space 147 through upper wall 203. Consequently, refrigerant gas 105 that remains in refrigerant reservoir 197 and is suctioned into inlet muffler 145 is cooled by refrigerant gas 105 in sound absorbing space 147.

In this suction process of refrigerant gas 105, part of refrigerant gas 105 remaining in refrigerant reservoir 197 is directly suctioned into inlet muffler 145 through communicating hole 207 formed in upper wall 203 of inlet-pipe inlet 155. Consequently, the suction efficiency of low-temperature refrigerant gas 105 is further increased.

When refrigerant gas 105 is thus suctioned into inlet muffler 145, lubricating oil 103 is deposited on lower wall 204 of refrigerant reservoir 197. In this case, inlet pipe 151 is arranged so that the inner wall surface of inlet-pipe inlet 155 forms stepped part 205 (a step height of dH) above the wall surface of lower wall 204. Accordingly, lubricating oil 103 deposited on lower wall 204 is resistant to being suctioned into inlet muffler 145.

If more lubricating oil 103 remains in lower wall 204, it is discharged outside inlet muffler 145 through discharge hole 206 formed in lower wall 204, which prevents lubricating oil 103 from being suctioned into inlet muffler 145.

Meanwhile, open end 210 with its diameter expanded, of suction piping 191 arranged facing refrigerant reservoir 197 of inlet muffler 145 is positioned near refrigerant reservoir 197, and the area facing refrigerant reservoir 197 has been increased. This results in expanding the reservoir space of inlet muffler 145 to increase the ratio of cooled refrigerant gas 105 to be suctioned into inlet muffler 145.

Additionally, the flow velocity of the refrigerant gas decreases at expanded open end 210 of suction piping 191, and thus an effect of decreasing the flow velocity of the refrigerant gas is further increased, which also increases the ratio of cooled refrigerant gas 105 to be suctioned into inlet muffler 145.

Meanwhile, in inlet muffler 145 according to the present invention, inlet-pipe outlet 157 of inlet pipe 151 extends to the bottom of hollow body 196 as shown in FIG. 5B. On the other hand, outlet-pipe inlet 167 of outlet pipe 153 is positioned at the heightwise central part of hollow body 196. Consequently, even if lubricating oil 103 temporarily stays at the bottom of inlet muffler 145, a large amount of lubricating oil 103 does not flow into the cooling system as long as lubricating oil 103 does not reach the height of the heightwise central part of hollow body 196.

FIG. 8 is a characteristic diagram showing the measurement result obtained from an experiment, of the temperature of a refrigerant gas near inlet-pipe inlet 155 of inlet pipe 151 of inlet muffler 145. Graph A shows a case without refrigerant reservoir 197 provided; graph B, a case with refrigerant reservoir 197 separately provided outside inlet muffler 145; and graph C, a case with refrigerant reservoir 197 integrally provided on inlet muffler 145. As shown in FIG. 8, the temperature at inlet-pipe inlet 155 is 53.1 degrees centigrade in case A, which is the highest; 50.9 degrees centigrade in case B, slightly lower than case A (a small difference). On the other hand, the temperature is 45.1 degrees centigrade in case C, showing a great effect of decreasing temperature. That is, this embodiment provides a great effect of decreasing temperature of refrigerant gas 105 suctioned into inlet muffler 145, thereby increasing the efficiency.

As described above, according to this embodiment, hollow body 196 has refrigerant reservoir 197 having a depressed part formed therein in a range including at least inlet-pipe inlet 155. Herewith, what is suctioned into inlet muffler 145 is virtually refrigerant gas 105 that has flown from suction piping 191 to remain. Hence, high-temperature refrigerant gas 105 flowing in the compressor is prevented from entering inlet muffler 145 to a minimum. This provides a highly efficient hermetic compressor in addition to the first embodiment.

According to this embodiment, refrigerant reservoir 197 is formed so that at least a part of its inside adjoins sound absorbing space 147. Herewith, low-temperature refrigerant gas 105 in inlet muffler 145 cools the side wall of hollow body 196, and thus the refrigerant gas remaining in refrigerant reservoir 197. Consequently, refrigerant gas 105 cooled is suctioned into inlet muffler 145, thereby providing a highly efficient hermetic compressor in addition to the first embodiment.

According to this embodiment, inlet pipe 151 is arranged so that the inner wall surface of inlet-pipe inlet 155 forms a stepped part above lower wall 204 of refrigerant reservoir 197. Accordingly, lubricating oil 103 remaining on the lower wall surface of refrigerant reservoir 197 is resistant to being suctioned into inlet muffler 145. Consequently, decrease of the reliability and efficiency due to compression of lubricating oil 103 is suppressed in addition to the first embodiment.

According to this embodiment, lower wall 204 of refrigerant reservoir 197 is provided with discharge hole 206 for lubricating oil 103. Herewith, lubricating oil 103 remaining on lower wall 204 of refrigerant reservoir 197 is discharged outside inlet muffler 145 and is resistant to being suctioned into inlet muffler 145. Consequently, decrease of the reliability and efficiency due to compression of lubricating oil 103 is suppressed in addition to the first embodiment.

According to this embodiment, the internal diameter of suction piping 191 is expanded at open end 210 more than at the other parts. Herewith, setting is made so that the ratio of the area of the opening of refrigerant reservoir 197 to that of the suction piping is a predetermined one. As a result, the reservoir space for refrigerant gas 105 near inlet pipe 151 is substantively expanded to increase the ratio of refrigerant gas 105 cooled to be suctioned into inlet muffler 145. This provides a further highly efficient hermetic compressor in addition to the first embodiment.

According to this embodiment, communicating hole 207 is provided communicating sound absorbing space 147 of inlet muffler 145 with refrigerant reservoir 197. Consequently, low-temperature refrigerant gas 105 is efficiently suctioned into inlet muffler 145 regardless of the structure of inlet pipe 151. This provides a further highly efficient hermetic compressor in addition to the first embodiment.

Third Exemplary Embodiment

Figure 9A:
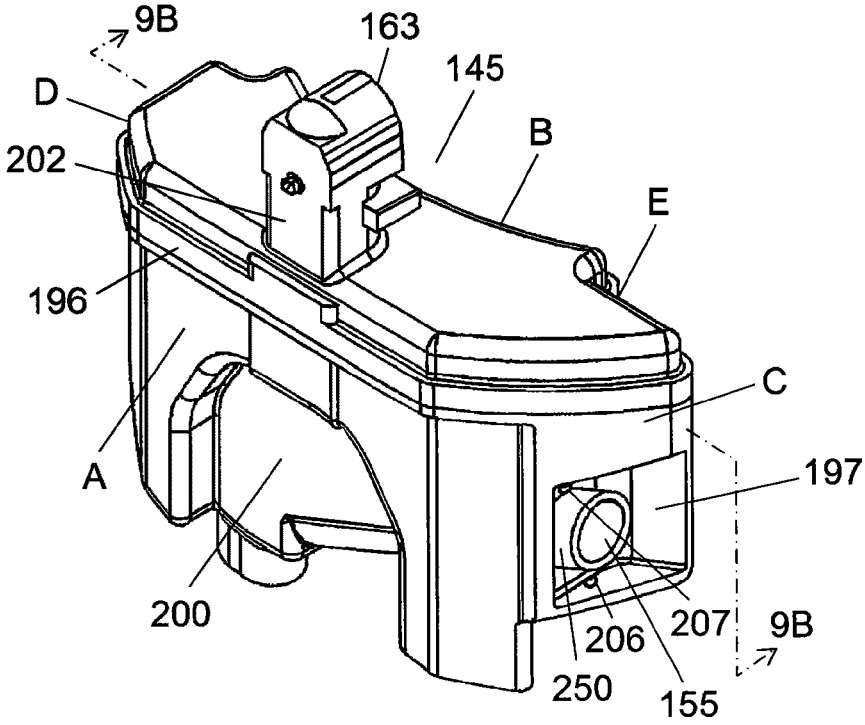
FIG. 9A is a perspective view illustrating the inlet muffler of a hermetic compressor according to the third exemplary embodiment of the present invention.
Figure 9B:
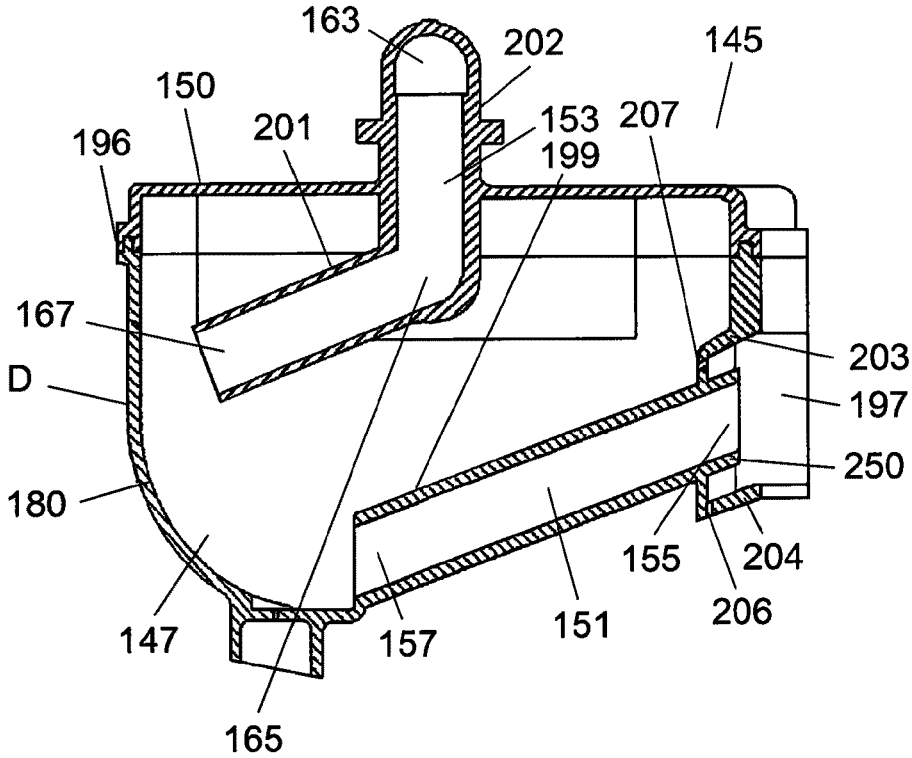
FIG. 9B is a cross sectional view of FIG. 9A, taken along line 9B-9B.
Figure 10:
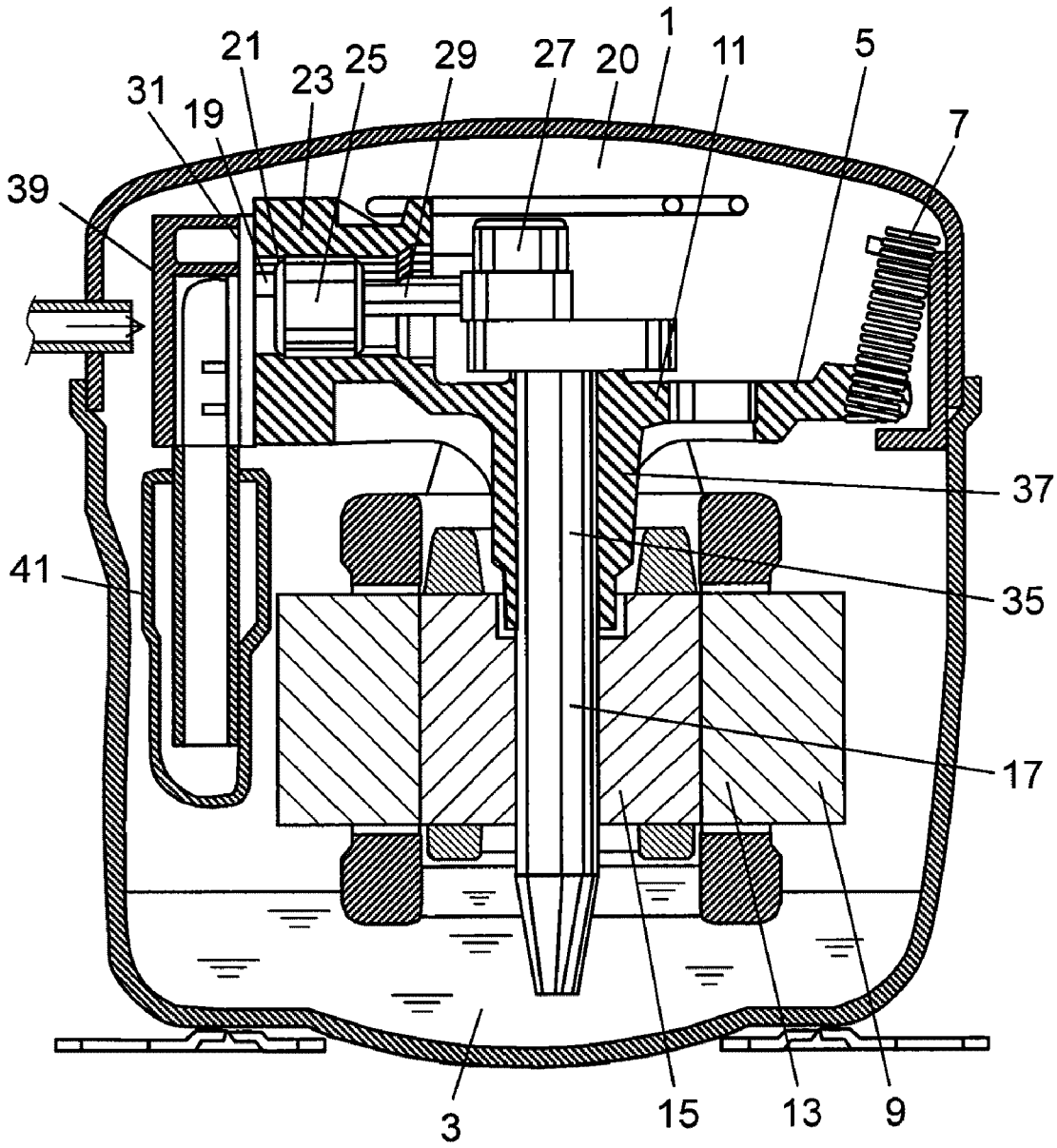
FIG. 10 Prior Art
FIG. 10 is a side sectional view of a conventional hermetic compressor.
Figure 11:
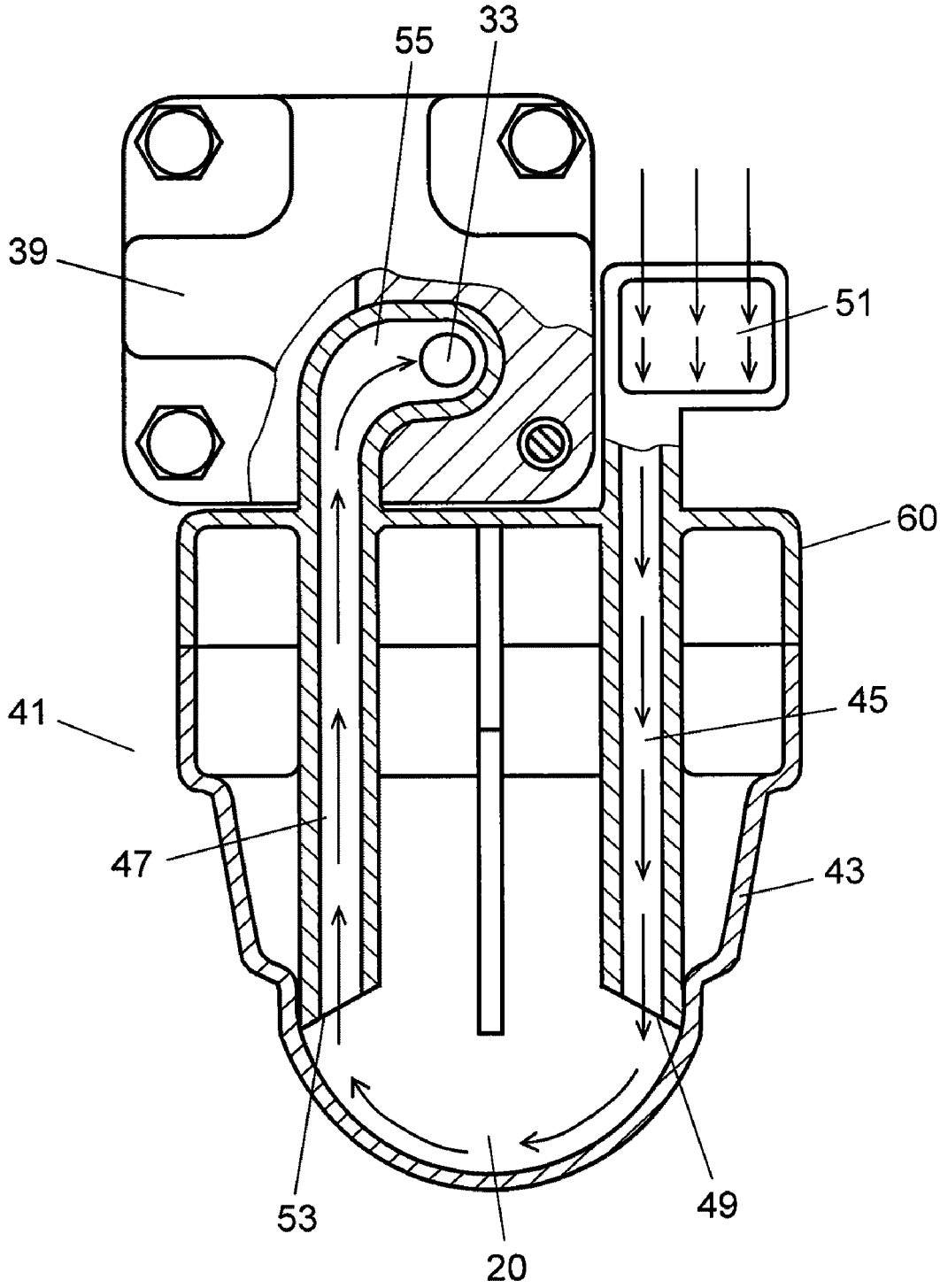
FIG. 11 Prior Art
FIG. 11 is a sectional view of the substantial part of the conventional hermetic compressor.
Figure 12:
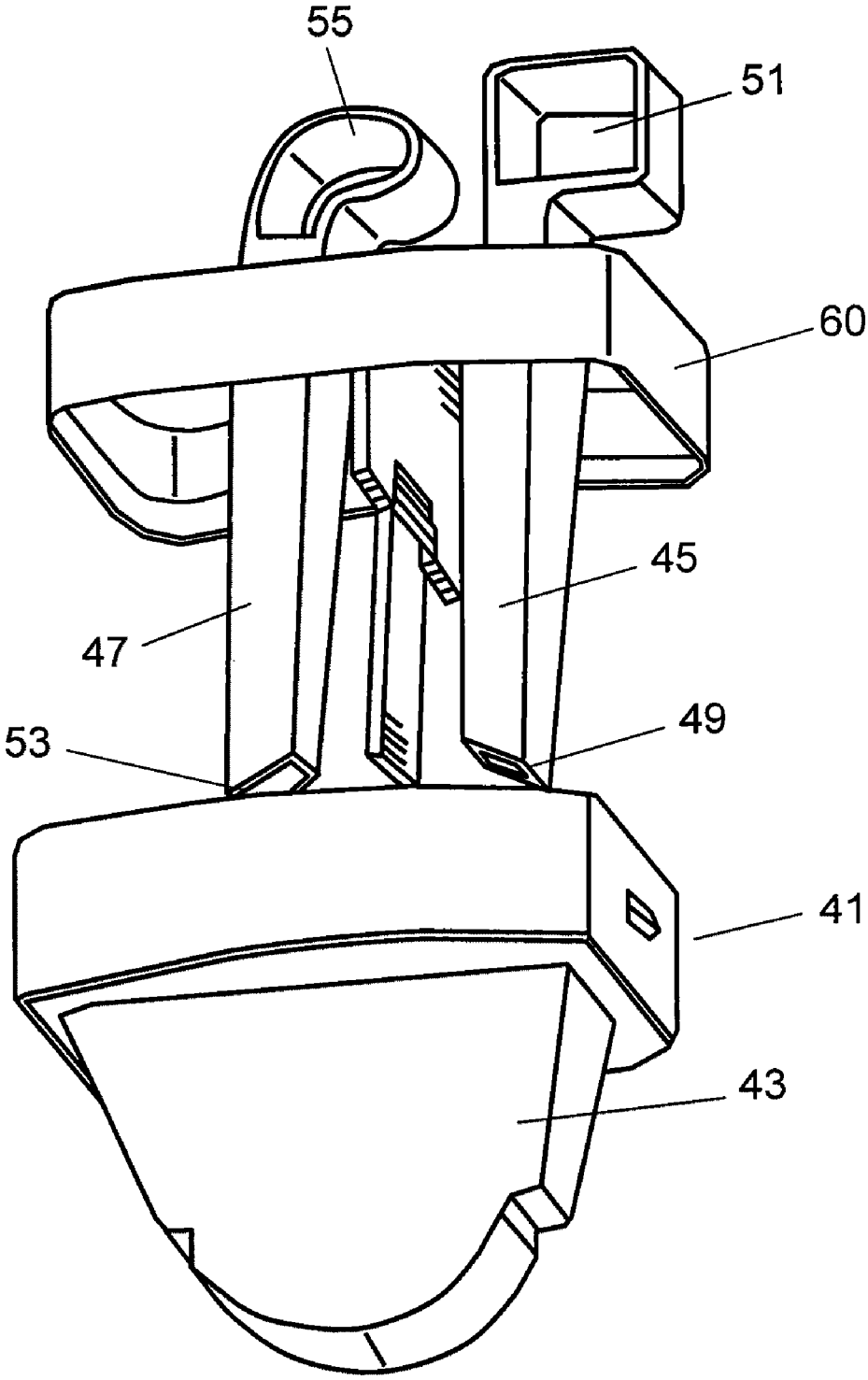
FIG. 12 Prior Art
FIG. 12 is an exploded perspective view of a conventional inlet muffler.

FIG. 9A is a perspective view illustrating inlet muffler 145 of a hermetic compressor according to the third exemplary embodiment of the present invention. FIG. 9B is a cross sectional view of FIG. 9A, taken along line 9B-9B.

In FIGS. 9A, 9B, a component given the same reference mark as that in FIGS. 4A to 8 shows the same component. This embodiment is different from the second one shown in FIGS. 4A through 8 in that inlet-pipe inlet 155 of inlet pipe 151 is provided with projection 250 projecting into refrigerant reservoir 197.

With such a structure, lubricating oil 103 deposited on lower wall 204 of refrigerant reservoir 197 is resistant to being suctioned into inlet pipe 151 with projection 250 being a barrier. As a result, lubricating oil 103 is still further resistant to being suctioned into inlet muffler 145.

In the second and third embodiments, only the upper part of refrigerant reservoir 197 contacts sound absorbing space 147. Besides the upper part, however, the side part of refrigerant reservoir 197 may contact sound absorbing space 147. In other words, as long as at least a part of the inner part of refrigerant reservoir 197 adjoins sound absorbing space 147, a cooling effect on refrigerant gas 105 is available.

As described above, according to this embodiment, inlet-pipe inlet 155 of inlet pipe 151 is provided with projection 250 projecting laterally from the wall surface of refrigerant reservoir 197. Herewith, lubricating oil 103 is still further resistant to being suctioned into inlet muffler 145. Consequently, decrease of the reliability and efficiency due to compression of lubricating oil 103 is suppressed in addition to the first and second embodiments.

INDUSTRIAL APPLICABILITY

As described above, a hermetic compressor according to the present invention stabilizes the performance and increases the efficiency, and thus is widely applicable to an air conditioner, vending machine, and other refrigerating equipment, not only to a home refrigerator.

The invention claimed is:

1. A hermetic compressor comprising a hermetic enclosure of which stores lubricating oil and has a suction piping for making a refrigerant gas flow into the hermetic enclosure, an electromotive element, and a compressing element driven by the electromotive element, wherein the compressing element includes a cylinder block forming a compression chamber, an inlet valve disposed at an end of the compression chamber, a piston reciprocating in and along the compression chamber, and an inlet muffler forming a sound absorbing space communicating with the compression chamber;

wherein the inlet muffler includes a hollow body forming the sound absorbing space, an inlet pipe communicating a space inside the hermetic enclosure with the sound absorbing space, and an outlet pipe communicating the sound absorbing space with the inlet valve;

wherein the inlet pipe is provided so as to be inclined downward from an inlet-pipe inlet having an opening open into the space inside the hermetic enclosure toward an inlet-pipe outlet having an opening open into the sound absorbing space;

wherein the outlet pipe includes an outlet-pipe inlet having an opening open into the sound absorbing space, and an outlet-pipe outlet having an opening open into the inlet valve; and wherein the inlet-pipe inlet and the outlet-pipe inlet are formed at same height.

2. The hermetic compressor of claim 1, wherein the outlet pipe has a curve curving obtusely at a central part between the outlet-pipe inlet and the outlet-pipe outlet.

3. The hermetic compressor of claim 1, wherein the inlet-pipe outlet is formed at a bottom of the sound absorbing space, and an inner wall surface of the hollow body is formed so as to introduce the refrigerant gas from an lower part of the sound absorbing space to an upper part of the sound absorbing space, between the inlet-pipe outlet and the outlet-pipe inlet.

4. The hermetic compressor of claim 3, wherein a lubricating oil discharge hole through which the lubricating oil is discharged outside the sound absorbing space is provided near the inlet-pipe outlet.

5. The hermetic compressor of claim 1, wherein the inlet muffler has a guide wall covering an upper part of the outlet-pipe inlet and guiding the refrigerant gas in the sound absorbing space into the outlet pipe.

6. The hermetic compressor of claim 1, wherein the outlet-pipe inlet has an opening near an inner wall surface of the hollow body.

7. The hermetic compressor of claim 1, wherein the hollow body has a refrigerant reservoir formed making the refrigerant gas remain in a range including at least the inlet-pipe inlet.

8. The hermetic compressor of claim 7, wherein the refrigerant reservoir is made of a concave part formed in a range including the inlet-pipe inlet of the hollow body.

9. The hermetic compressor of claim 7, wherein the suction piping and the inlet pipe are arranged so that an open end of the suction piping and the inlet-pipe inlet face each other, and the inlet-pipe inlet is arranged upstream in a flowing direction of the refrigerant gas and on a side wall of the hollow body, opposite to a surface that the flow of the refrigerant gas first touches.

10. The hermetic compressor of claim 9, wherein an internal diameter of the suction piping is larger at an open end facing the refrigerant reservoir than the other part of the suction piping.

11. The hermetic compressor of claim 7, wherein at least a part of the refrigerant reservoir adjoins the sound absorbing space.

12. The hermetic compressor of claim 7, wherein the inlet-pipe inlet is arranged above a lower wall surface of the refrigerant reservoir.

13. The hermetic compressor of claim 7, wherein the inlet-pipe inlet has a projection projecting into the hermetic enclosure from a wall surface of the refrigerant reservoir.

14. The hermetic compressor of claim 7, wherein a discharge hole for the lubricating oil is provided on a lower wall surface of the refrigerant reservoir.

15. The hermetic compressor of claim 7, wherein the hollow body has a communicating hole communicating the sound absorbing space of the inlet muffler with the refrigerant reservoir.

* * * * *